US010181670B2

(12) United States Patent
Schmitt et al.

(10) Patent No.: US 10,181,670 B2
(45) Date of Patent: Jan. 15, 2019

(54) CONNECTOR SUB-ASSEMBLY AND ELECTRICAL CONNECTOR HAVING SIGNAL AND GROUND CONDUCTORS

(71) Applicant: TYCO ELECTRONICS CORPORATION, Berwyn, PA (US)

(72) Inventors: Matthew Ryan Schmitt, Middletown, PA (US); Brandon Michael Matthews, McAlisterville, PA (US); Steve Douglas Sattazahn, Lebanon, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 205 days.

(21) Appl. No.: 15/134,991

(22) Filed: Apr. 21, 2016

(65) Prior Publication Data

US 2017/0310035 A1 Oct. 26, 2017

(51) Int. Cl.
*H01R 13/405* (2006.01)
*H01R 43/24* (2006.01)
*H01R 13/6471* (2011.01)

(52) U.S. Cl.
CPC ..... *H01R 13/405* (2013.01); *H01R 13/6471* (2013.01); *H01R 43/24* (2013.01)

(58) Field of Classification Search
CPC .. H01R 13/405; H01R 13/6471; H01R 43/24; H01R 13/652; H01R 13/6597
USPC ..... 439/607.58, 108, 637
See application file for complete search history.

(56) References Cited

U.S. PATENT DOCUMENTS

| | | | | |
|---|---|---|---|---|
| 8,870,594 | B2 | 10/2014 | McClellan et al. | |
| 9,385,479 | B1 * | 7/2016 | Schmitt | H01R 13/6471 |
| 2012/0315796 | A1 * | 12/2012 | Pang | H01R 13/6471 439/626 |
| 2016/0211629 | A1 * | 7/2016 | Phillips | H01R 13/6471 |

* cited by examiner

*Primary Examiner* — Edwin A. Leon

(57) ABSTRACT

Connector sub-assembly includes a plurality of signal conductors. The connector sub-assembly also includes a ground frame having ground conductors and a ground bus that interconnects the ground conductors. The ground bus has opposite first and second sides. The connector sub-assembly also includes a dielectric carrier that surrounds the ground bus and intermediate segments of the signal conductors. Mating segments of the signal conductors project from the dielectric carrier and are configured to engage corresponding contacts of a mating connector. The signal conductors include first conductors and second conductors, and the ground conductors are interleaved between adjacent first and second conductors. The intermediate segments of the first conductors extend adjacent to the first side of the ground bus. The intermediate segments of the second conductors extend adjacent to the second side of the ground bus.

18 Claims, 7 Drawing Sheets

CONNECTOR SUB-ASSEMBLY AND ELECTRICAL CONNECTOR HAVING SIGNAL AND GROUND CONDUCTORS

BACKGROUND

The subject matter herein relates generally to electrical connectors having signal conductors configured to convey data signals and ground conductors that reduce crosstalk between the signal conductors.

Communication systems exist today that utilize electrical connectors to transmit data. For example, network systems, servers, data centers, and the like may use numerous electrical connectors to interconnect the various devices of the communication system. Many electrical connectors include signal conductors and ground conductors in which the signal conductors convey data signals and the ground conductors reduce crosstalk between the signal conductors. In a common configuration, the signal conductors are arranged in signal pairs for carrying differential signals, and the ground conductors are positioned between the signal pairs to, among other things, reduce crosstalk. Each signal pair may be separated from adjacent signal pairs by one or more ground conductors. For example, the signal and ground conductors may be arranged in a ground-signal-signal-ground (GSSG) pattern.

There has been a general demand to increase the density of signal conductors within the electrical connectors and/or increase the speeds at which data is transmitted through the electrical connectors. As data rates increase and/or distances between the signal conductors decrease, however, it becomes more challenging to maintain a baseline level of signal quality. For example, at least some known electrical connectors are manufactured using a leadframe. The leadframe is stamped from a common sheet of material (e.g., sheet metal) to form the signal conductors and, optionally, the ground conductors. Conventional machinery, however, may have operating parameters that limit a minimum size and/or a maximum density of conductors that can be formed. For instance, it can be challenging to reduce the center-to-center spacing between electrical conductors of a leadframe to less than 0.80 mm.

Accordingly, there is a need for an electrical connector having a greater density of signal conductors than other known connectors while also providing good signal quality.

BRIEF DESCRIPTION

In an embodiment, a connector sub-assembly for an electrical connector is provided. The connector sub-assembly includes a plurality of signal conductors in which each signal conductor includes a mating segment, a terminating segment, and an intermediate segment that extends between the corresponding mating and terminating segments. The connector sub-assembly also includes a ground frame having ground conductors and a ground bus that interconnects the ground conductors. The ground bus has opposite first and second sides. The connector sub-assembly also includes a dielectric carrier that surrounds the ground bus and the intermediate segments of the signal conductors. The mating segments of the signal conductors project from the dielectric carrier and are configured to engage corresponding contacts of a mating connector. The signal conductors include first conductors and second conductors and the ground conductors are interleaved between adjacent first and second conductors. The intermediate segments of the first conductors extend adjacent to the first side of the ground bus. The intermediate segments of the second conductors extend adjacent to the second side of the ground bus.

In some embodiments, the intermediate segments of the first and second conductors have non-linear paths. The non-linear paths may extend around the ground bus. Alternatively or in addition to extending around the ground bus, the non-linear paths may increase corresponding gaps between the adjacent first and second conductors.

In some embodiments, the signal conductors and the ground conductors form a conductor row having a center-to-center spacing that is at most 0.6 millimeters (mm).

In some embodiments, the first conductors form first signal pairs and the second conductors form second signal pairs. The ground conductors may be interleaved between the first and second signal pairs to form a ground-signal-signal-ground (GSSG) pattern.

In some embodiments, the connector sub-assembly may include conductive material that is from different conductive blanks or leadframes. For example, the ground frame includes a ground material and the first and second conductors include a signal material. The signal material and the ground material may be different. Alternatively or in addition to the signal and ground materials being different, the first conductors and the second conductors may have different structural features that are indicative of originating from different conductive blanks.

In an embodiment, an electrical connector is provided that includes a connector housing having a mating side and a loading side and a connector cavity that opens to the mating side and to the loading side. The electrical connector also includes a connector sub-assembly disposed within the connector cavity. The connector sub-assembly includes a plurality of signal conductors in which each signal conductor includes a mating segment, a terminating segment, and an intermediate segment that extends between the corresponding mating and terminating segments. The connector sub-assembly also includes a ground frame having ground conductors and a ground bus that interconnects the ground conductors. The ground bus has opposite first and second sides. The connector sub-assembly also includes a dielectric carrier that surrounds the ground bus and the intermediate segments of the signal conductors. The mating segments of the signal conductors project from the dielectric carrier and are configured to engage corresponding contacts of a mating connector. The signal conductors include first conductors and second conductors and the ground conductors are interleaved between adjacent first and second conductors. The intermediate segments of the first conductors extend adjacent to the first side of the ground bus. The intermediate segments of the second conductors extend adjacent to the second side of the ground bus.

In an embodiment, a method is provided that includes positioning a plurality of conductive blanks adjacent to one another. Each of the conductive blanks has electrical conductors and body panels that support the electrical conductors. The electrical conductors of the conductive blanks form a common conductor array when the conductive blanks are positioned adjacent to one another. The method also includes molding a dielectric material around the electrical conductors to form a dielectric carrier. The electrical conductors include intermediate segments that extend through the dielectric carrier and mating segments that project away from an exterior of the dielectric carrier. The mating segments are configured to engage corresponding contacts of a mating connector. The method also includes separating the electrical conductors from the corresponding body panels.

DETAILED DESCRIPTION

Figure 1:
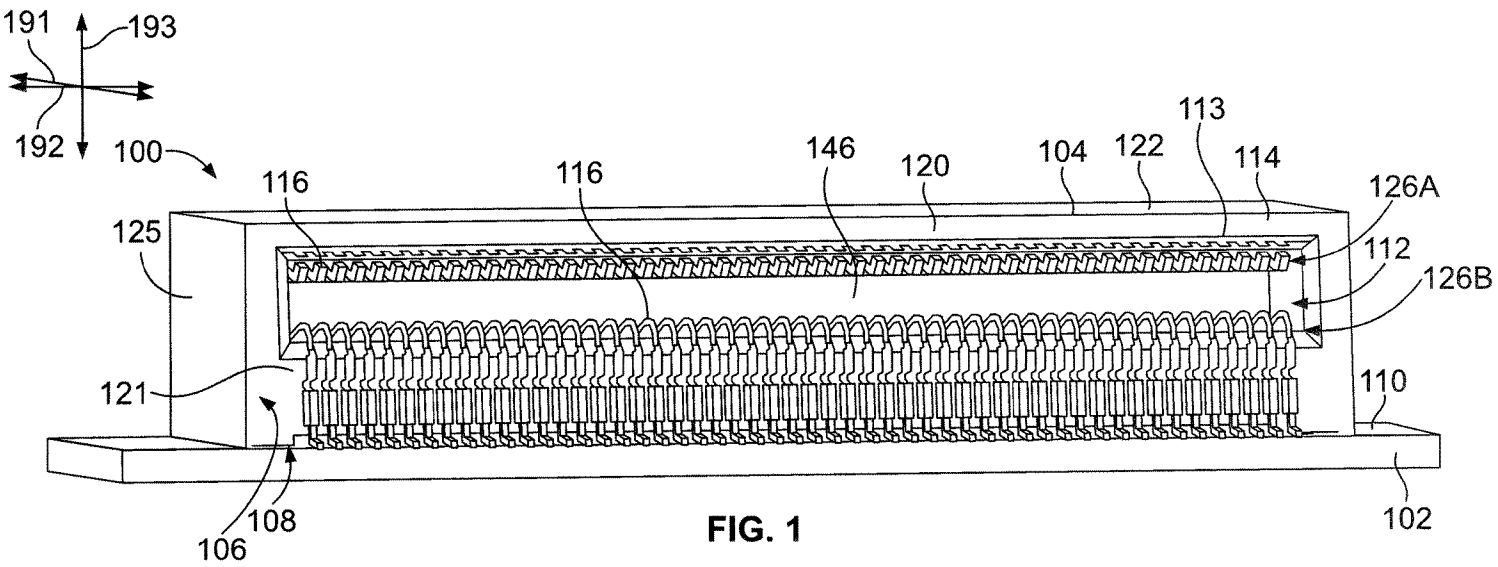
FIG. 1 is a perspective view of a circuit board assembly having an electrical connector in accordance with an embodiment.

Embodiments set forth herein may include various connector sub-assemblies and electrical connectors that are configured for communicating data signals. The electrical connectors may be configured to mate with a corresponding mating connector to communicatively interconnect different components of a communication system. In some embodiments, the electrical connector is a receptacle connector that is mounted to and electrically coupled to a circuit board. The receptacle connector is configured to mate with a pluggable input/output (I/O) connector during a mating operation. It should be understood, however, that the inventive subject matter set forth herein may be applicable to other types of electrical connectors. For example, embodiments may include header connectors or receptacle connectors of a backplane or midplane communication system.

The electrical connectors may be particularly suitable for high-speed communication systems, such as network systems, servers, data centers, and the like. For example, the electrical connectors described herein may be high-speed electrical connectors that are capable of transmitting data at a data rate of at least about five (5) gigabits per second (Gbps), at least about 10 Gbps, at least about 20 Gbps, at least about 40 Gbps, at least about 56 Gbps, or more. In some embodiments, the electrical connector may be configured to transmit data signals at slower data rates (e.g., less than 5 Gbps). One or more embodiments may also transmit power in addition to transmitting high speed data signals.

The connector sub-assemblies and the electrical connectors include signal and ground conductors that are positioned relative to one another to form a designated array. Optionally, the designated array includes one or more rows (or columns). The signal and ground conductors of a single row (or column) may be substantially co-planar. For example, the signal conductors may form signal pairs in which each signal pair is flanked on both sides by ground conductors. The ground conductors electrically separate the signal pairs to reduce electromagnetic interference or crosstalk, to provide a reliable ground return path, and/or to control impedance. The signal and ground conductors in a single row may be patterned to form multiple sub-arrays. Each sub-array includes, in order, a ground conductor, a signal conductor, a signal conductor, and a ground conductor. This arrangement is referred to as ground-signal-signal-ground (or GSSG) sub-array. The sub-array may be repeated such that an exemplary row of conductors may form G-S-S-G-G-S-S-G-G-S-S-G, wherein two ground conductors are positioned between two adjacent signal pairs. In the illustrated embodiment, however, adjacent signal pairs share a ground conductor such that the pattern forms G-S-S-G-S-S-G-S-S-G. In both examples above, the sub-array is referred to as a GSSG sub-array. More specifically, the term "GSSG sub-array" includes sub-arrays that share one or more intervening ground conductors. Although some embodiments include signal pairs that are configured for differential signaling, it should be understood that other embodiments may not include signal pairs.

FIG. 1 is a perspective view of a portion of a circuit board assembly 100 formed in accordance with an embodiment. The circuit board assembly 100 includes a circuit board 102 and an electrical connector 104 that is mounted onto a surface 110 of the circuit board 102. The circuit board assembly 100 is oriented with respect to mutually perpendicular axes, including a mating axis 191, a lateral axis 192, and a vertical or elevation axis 193. In FIG. 1, the vertical axis 193 extends parallel to a gravitational force direction. It should be understood, however, that embodiments described herein are not limited to having a particular orientation with respect to gravity. For example, the lateral axis 192 may extend parallel to the gravitational force direction in other embodiments.

In some embodiments, the circuit board assembly 100 may be a daughter card assembly that is configured to engage a backplane or midplane communication system (not shown). In other embodiments, the circuit board assembly 100 may include a plurality of the electrical connectors 104 mounted to the circuit board 102 along an edge of the circuit board 102 in which each of the electrical connectors 104 is configured to engage a corresponding pluggable input/output (I/O) connector 105 (shown in FIG. 2), which may be referred to generally as a mating connector. The electrical connectors 104 and pluggable I/O connectors 105 may be configured to satisfy certain industry standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard. In some embodiments, the pluggable I/O connector may be configured to be compliant with a small form factor (SFF) specification, such as SFF-8644 and SFF-8449 HD. In some embodiments, the pluggable I/O connector may be similar to the μQSFP (or microQSFP) connector developed by TE Connectivity.

Although not shown, each of the electrical connectors 104 may be positioned within a receptacle cage. The receptacle cage may be configured to receive one of the pluggable I/O connectors 105 during a mating operation and direct the pluggable I/O connector 105 toward a mated position with the corresponding electrical connector 104. The circuit board assembly 100 may also include other devices that are communicatively coupled to the electrical connectors 104 through the circuit board 102. For example, the circuit board assembly 100 may include connectors (not shown) that are configured to mate with header connectors (not shown) along a backplane or midplane.

In the illustrated embodiment, the electrical connector 104 is a receptacle connector that is configured to mate with the pluggable I/O connector 105 (shown in FIG. 2), which is hereinafter referred to as the mating connector. The electrical connector 104 extends between a mating side or face 106 and a mounting side 108. The mounting side 108 is terminated to the surface 110 of the circuit board 102. The mating side 106 defines an interface for connecting to the mating connector 105. In the illustrated embodiment, the electrical connector 104 includes a connector cavity 112 that is shaped to receive a portion of the mating connector 105 therein.

The electrical connector 104 in the illustrated embodiment is a right-angle style connector such that the mating side 106 is oriented generally perpendicular to the mounting side 108. The connector cavity 112 is configured to receive the mating connector 105 in a loading direction that is parallel to the surface 110 of the circuit board 102. In an alternative embodiment, the connector 104 may be a vertical style connector in which the mating end is generally opposite to the mounting end, and the connector receives the mating connector 105 in a loading direction that is transverse to the surface 110. In another alternative embodiment, the electrical connector 104 may be terminated to an electrical cable instead of to the circuit board 102.

The electrical connector 104 includes a connector housing 114 that defines the mating side 106 and the mounting side 108. The mounting side 108 abuts or at least faces the surface 110 of the circuit board 102. The connector housing 114 also includes a top side 122 and a loading side 125. Optionally, the connector cavity 112 also opens to the loading side 125. For example, the connector cavity 112 may be sized and shaped to receive a rear connector assembly 146 through the loading side 125. Alternatively, the rear connector sub-assembly 146 may be inserted through the mating side 106.

As used herein, relative or spatial terms such as "front," "rear," "first," "second," "left," and "right" are used only to distinguish the referenced elements and do not necessarily require particular positions or orientations in the circuit board assembly 100 or the electrical connector 104 relative to gravity or to the surrounding environment. The mating side 106 defines an opening 113 along the mating side 106 of the connector 104 that provides access to the connector cavity 112. The connector cavity 112 is defined vertically between an upper side wall 120 and a lower side wall 121.

The electrical connector 104 also includes electrical conductors 116 that are held at least partially within the connector housing 114. The electrical conductors 116 are configured to provide conductive pathways through the electrical connector 104. In an embodiment, the electrical conductors 116 are organized in first and second arrays 126A, 126B. The electrical conductors 116 in the first and second arrays 126A, 126B are arranged side-by-side in respective conductor rows extending parallel to the lateral axis 192 such that the electrical conductors 116 in each conductor row essentially form a one-dimensional (1D) array. The electrical conductors 116 in the first array 126A extend at least partially into the connector cavity 112 from the upper side wall 120, and the electrical conductors 116 of the second array 126B extend at least partially into the connector cavity 112 from the lower side wall 121. In other embodiments, the electrical connector 104 may include only one array or more than two arrays. In other embodiments, the arrays may be two-dimensional (2D) arrays.

Figure 2:
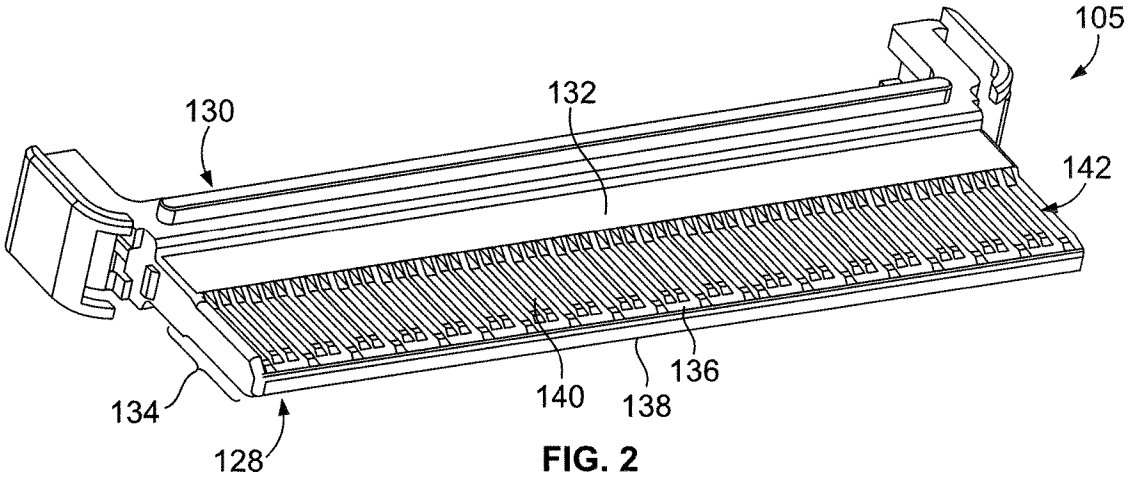
FIG. 2 is a perspective view of a portion of a mating connector that is configured to mate with the electrical connector of FIG. 1.

FIG. 2 is a perspective view of the mating connector 105. The mating connector 105 extends between a mating end 128 and a terminating end 130. The terminating end 130 of the mating connector 105 may be configured to terminate to an electrical cable (not shown) or, alternatively, to a circuit card or the like. The mating connector 105 includes a plug housing 132 that extends between the mating and terminating ends 128, 130. The plug housing 132 includes a front tray 134 that defines the mating end 128 and extends towards the terminating end 130. The front tray 134 is configured to be loaded into the connector cavity 112 of the electrical connector 104. The front tray 134 defines a first outer surface 136 and an opposite second outer surface 138. The mating connector 105 includes mating contacts 140 that are exposed on the front tray 134 for engaging corresponding conductors 116 of the electrical connector 104. An array 142 of mating contacts 140 extends in a planar row on the first outer surface 136. Although not shown, the mating connector 105 includes another array of mating contacts 140 disposed on the second outer surface 138.

During mating, as the front tray 134 of the mating connector 105 is received within the connector cavity 112 of the electrical connector 104, the mating contacts 140 along the first outer surface 136 engage corresponding conductors 116 in the first array 126A that extend from the upper side wall 120, and the mating contacts 140 along the second outer surface 138 engage corresponding conductors 116 in the second array 126B that extend from the lower side wall 121. The electrical conductors 116 may be configured to deflect towards the respective side walls 120, 121 from which the electrical conductors 116 extend in order to exert a biased retention force on the corresponding mating contacts 140 to retain mechanical and electrical contact with the mating contacts 140.

Figure 3:
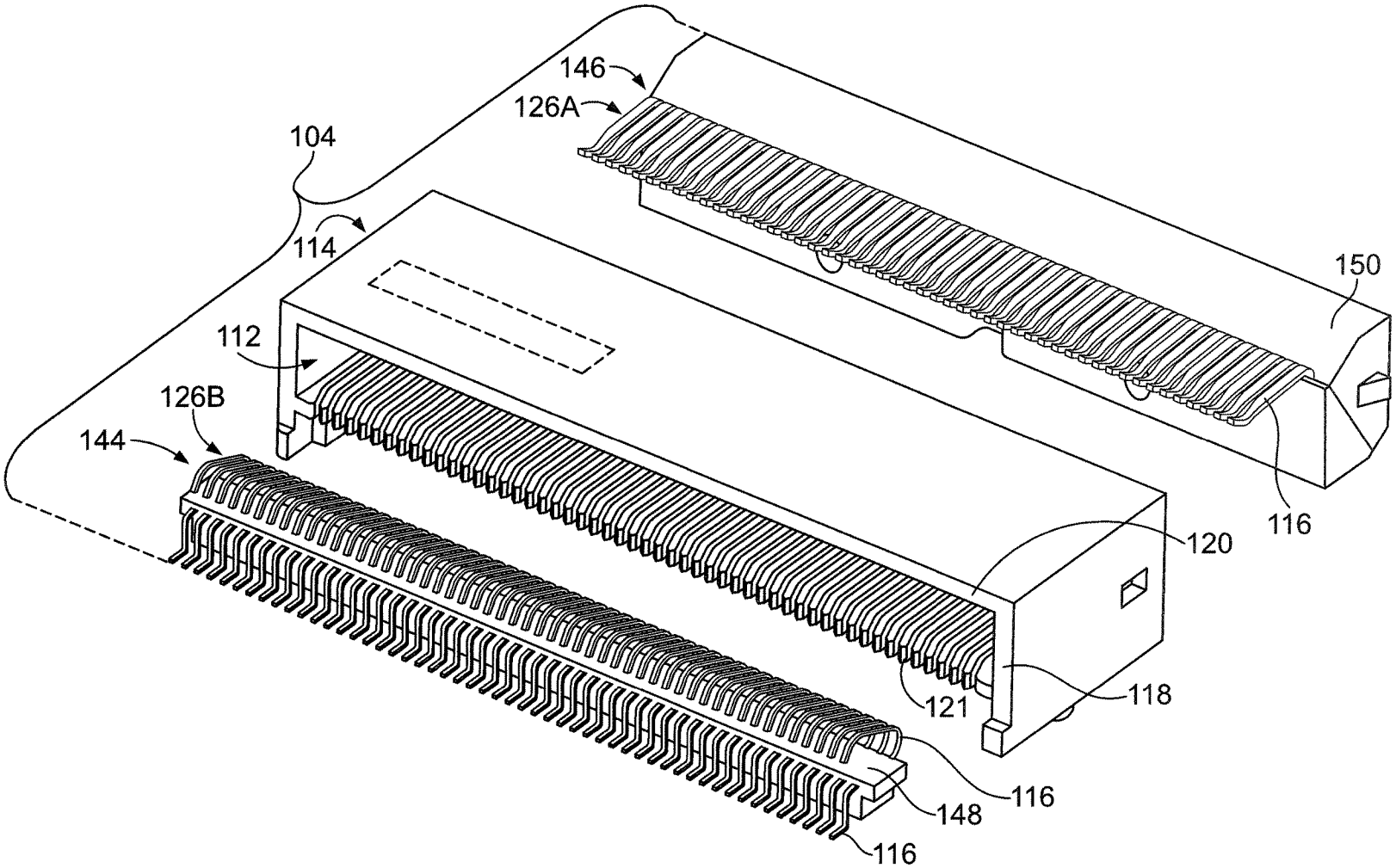
FIG. 3 is a partially exploded view of the electrical connector of FIG. 1.

FIG. 3 is an exploded view of the electrical connector 104. The electrical connector 104 includes the connector housing 114, a front connector sub-assembly 144, and the rear connector sub-assembly 146. The front and rear connector sub-assemblies 144, 146 are configured to be received within the connector housing 114 and secured to the connector housing 114 to assemble the electrical connector 104. The front and rear connector sub-assemblies 144, 146 hold the electrical conductors 116 of the electrical connector 104. For example, the front connector sub-assembly 144 includes the second array 126B of the conductors 116. The rear connector sub-assembly 146 includes the first array 126A of the conductors 116.

The front connector sub-assembly 144 includes a front dielectric carrier 148 that that surrounds segments of the electrical conductors 116 of the second array 126B to secure the positioning and orientation of the corresponding electrical conductors 116. The front dielectric carrier 148 is composed of a dielectric material that includes one or more plastics or other polymers. The front dielectric carrier 148 holds the electrical conductors 116 in spaced-apart positions to electrically isolate the electrical conductors 116 in the second array 126B from one another. In particular embodiments, the dielectric carrier 148 is overmolded in a single step over the electrical conductors 116, a process referred to herein as a single-shot overmold. In such embodiments, the dielectric carrier 148 may be a unitary structure or part that encases segments of the electrical conductors 116.

In some embodiments, the front connector sub-assembly 144 is configured to convey low speed data signals, control signals, and/or power, but not high speed data signals. Since the signal-transmitting electrical conductors 116 are not configured to convey high speed data signals, the electrical conductors 116 that provide grounding and shielding between the signal-transmitting electrical conductors 116 may not be electrically commoned. In other embodiments, however, the front connector sub-assembly 144 may be configured to transmit high speed data signals, and the electrical conductors 116 that provide grounding optionally may be electrically commoned. For example, the front connector sub-assembly 144 may be constructed in a similar manner as the connector sub-assembly 202 (shown in FIG. 4).

The rear connector sub-assembly 146 includes a rear dielectric carrier 150 that encases segments of the electrical conductors 116 of the first array 126A to secure the positioning and orientation of the electrical conductors 116. Like the front dielectric carrier 148, the rear dielectric carrier 150 is composed of a dielectric material that includes one or more plastics or other polymers. The rear dielectric carrier 150 electrically isolates the electrical conductors 116 of the first array 126A from one another. In particular embodiments, the dielectric carrier 150 may be overmolded in a single step over the corresponding electrical conductors 116, a process referred to herein as a single-shot overmold. In such embodiments, the dielectric carrier 150 may be a unitary structure or part that encases segments of the corresponding electrical conductors 116.

In the illustrated embodiment, the rear connector sub-assembly 146 is configured to convey high speed data signals. Optionally, the rear connector sub-assembly 146 may be used to convey low speed data signals, control signals, and/or power. The rear connector sub-assembly 146 may include a ground bus, such as the ground bus 284 (shown in FIG. 6), that electrically commons the electrical conductors 116 that provide grounding and shielding for the electrical conductors 116 that transmit data signals. The rear connector sub-assembly 146 may be constructed in a similar manner as the connector sub-assembly 202 (FIG. 4).

Although the illustrated embodiment includes two connector sub-assemblies that are disposed within the connector cavity 112 of the connector housing 114, other embodiments may include only one connector sub-assembly, such as the front connector sub-assembly 144, the rear connector sub-assembly 146, or another connector sub-assembly. Alternatively, embodiments may include more than two connector sub-assemblies. For example, alternative embodiments may include a receptacle connector of a backplane/midplane system that has a series of connector sub-assemblies stacked side-by-side.

Figure 4:
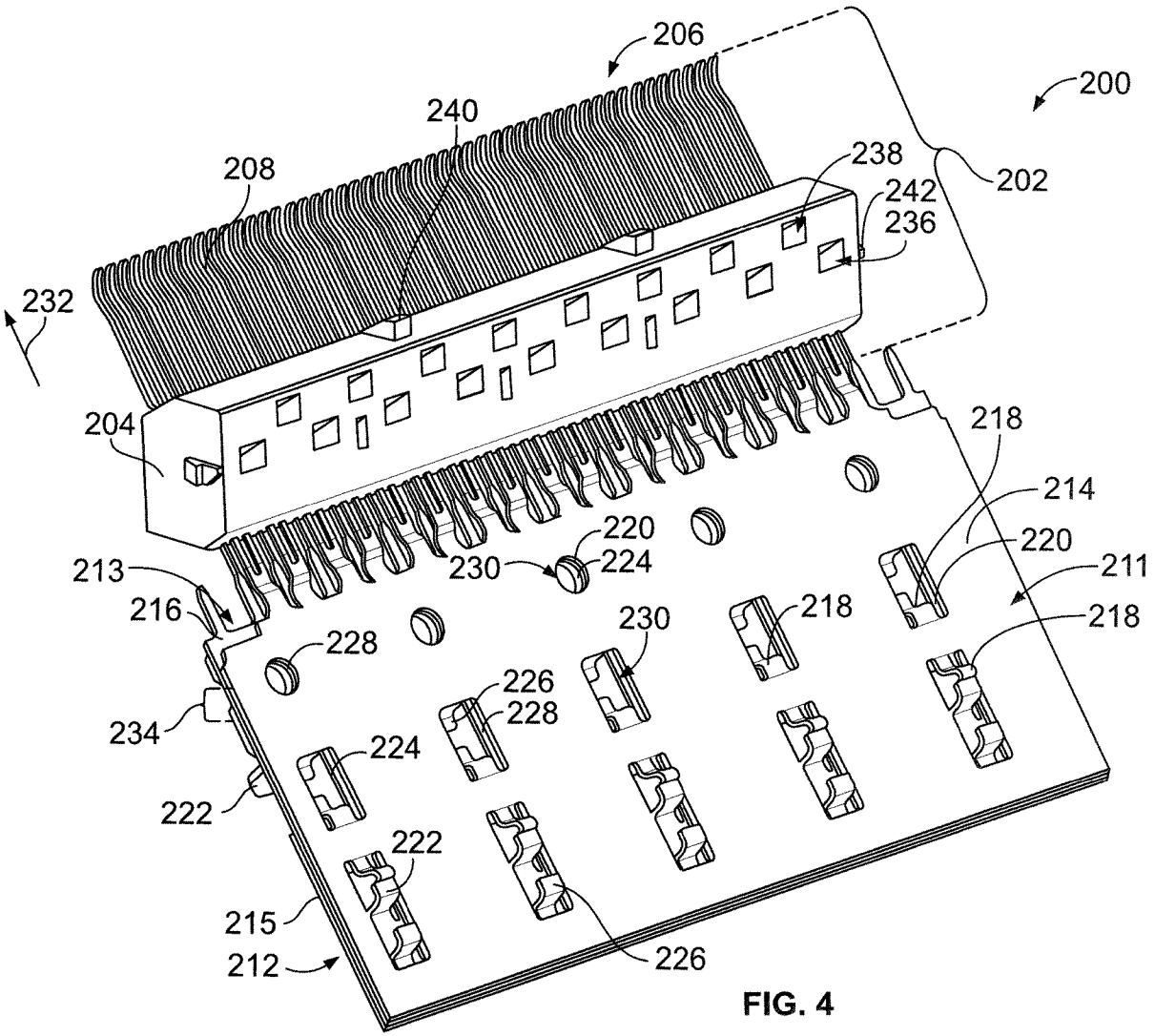
FIG. 4 is an isolated perspective view of a manufacturing sub-assembly that may be used to construct a connector sub-assembly in accordance with an embodiment.

FIG. 4 is a perspective view of a manufacturing sub-assembly 200 that includes a connector sub-assembly 202 in accordance with an embodiment. The connector sub-assembly 202 is only partially formed in FIG. 4. The connector sub-assembly 202 may form a portion of an electrical connector, such as the electrical connector 104 (FIG. 1). For example, the connector sub-assembly 202 may be similar or identical to the rear connector sub-assembly 146 (FIG. 1) and replace the rear connector sub-assembly 146 in some embodiments. The connector sub-assembly 202 includes a dielectric carrier 204 and an array 206 of electrical conductors 208. Because the illustrated array 206 is a 1D array having the electrical conductors 208 arranged side-by-side, the array 206 is hereinafter referred to as a conductor row 206. It should be understood, however, that other embodiments may include arrays that are not 1D.

The dielectric carrier 204 includes a plurality of air channels 236, 238 that extend through the dielectric carrier 204. The dielectric carrier 204 may also include interference features 240, 242 that are configured to engage a connector housing (not shown), such as the connector housing 114 (FIG. 1), when an electrical connector is assembled. In the illustrated embodiment, the interference features 240, 242 are projections that are positioned along an exterior of the dielectric carrier 204. The projections may form an interference fit with corresponding recesses of the connector housing. In other embodiments, however, one or more of the interference features 240, 242 may be recesses that are configured to engage corresponding projections (not shown) of the connector housing.

The manufacturing sub-assembly 200 may be formed during the manufacture of the connector sub-assembly 202 or a corresponding electrical connector. As shown in FIG. 4, the manufacturing sub-assembly 200 includes a plurality of discrete conductive blanks or leadframes 211, 212, 213 and the dielectric carrier 204. Each of the conductive blanks 211-213 may be stamped and, optionally, formed or shaped. The conductive blanks 211-213 may have different shapes or profiles.

The conductive blanks 211-213 include a first signal blank 211, a second signal blank 212, and a ground blank 213. Alternative embodiments may include fewer conductive blanks or additional conductive blanks. The conductive blanks 211-213 include respective body panels 214, 215, 216 and respective sub-arrays of the electrical conductors 208. Each of the body panels 214-216 is a substantially planar panel stamped from sheet material. The electrical conductors 208 project in a generally common direction 232 from the respective body panels 214-216. In FIG. 4, the conductive blanks 211-213 are stacked adjacent to one another such that the electrical conductors 208 of the respective conductive blanks 211-213 form a designated arrangement of the conductor row 206. The electrical conductors 208 may be generally parallel to one another. In particular embodiments, the body panels 214-216 may be stacked side-by-side. When the body panels 214-216 are stacked side-by-side, the conductive blanks 211-213 form a working stack 234.

In the illustrated embodiment, each of the body panels 214-216 includes a plurality of alignment features that engage at least one of the other body panels and/or are configured to engage other features for holding the conductive blanks 211-213 in fixed positions with respect to one another. For example, the body panel 214 includes alignment projections or tabs 218 and alignment openings or holes 220. The body panel 215 includes alignment projections or tabs 222 and alignment openings or holes 224. The body panel 216 includes alignment projections or tabs 226 and alignment openings or holes 228. In the illustrated embodiment, the alignment openings 220, 224, and 228 are aligned to form alignment passages 230, and the alignment tabs 218, 222, and 226 extend through the alignment passages 230. Optionally, the alignment tabs 218, 222, 226 may engage interior edges that define one or more of the alignment openings 220, 224, 228 to align the body panels 214-216 with one another.

The alignment tabs 218, 222, 226 may be configured to engage or grip other components (not shown) for holding the conductive blanks 211-213 at a designated position. For example, the alignment tabs 218, 222, 226 are shaped at distal ends to form hooks or grips. Optionally, one or more of the alignment passages 230 may receive elements (not shown) of another structure (e.g., rod or post) (not shown) that engage the interior edges of the body panels 214-216 to position the conductive blanks 211-213.

Figure 5:
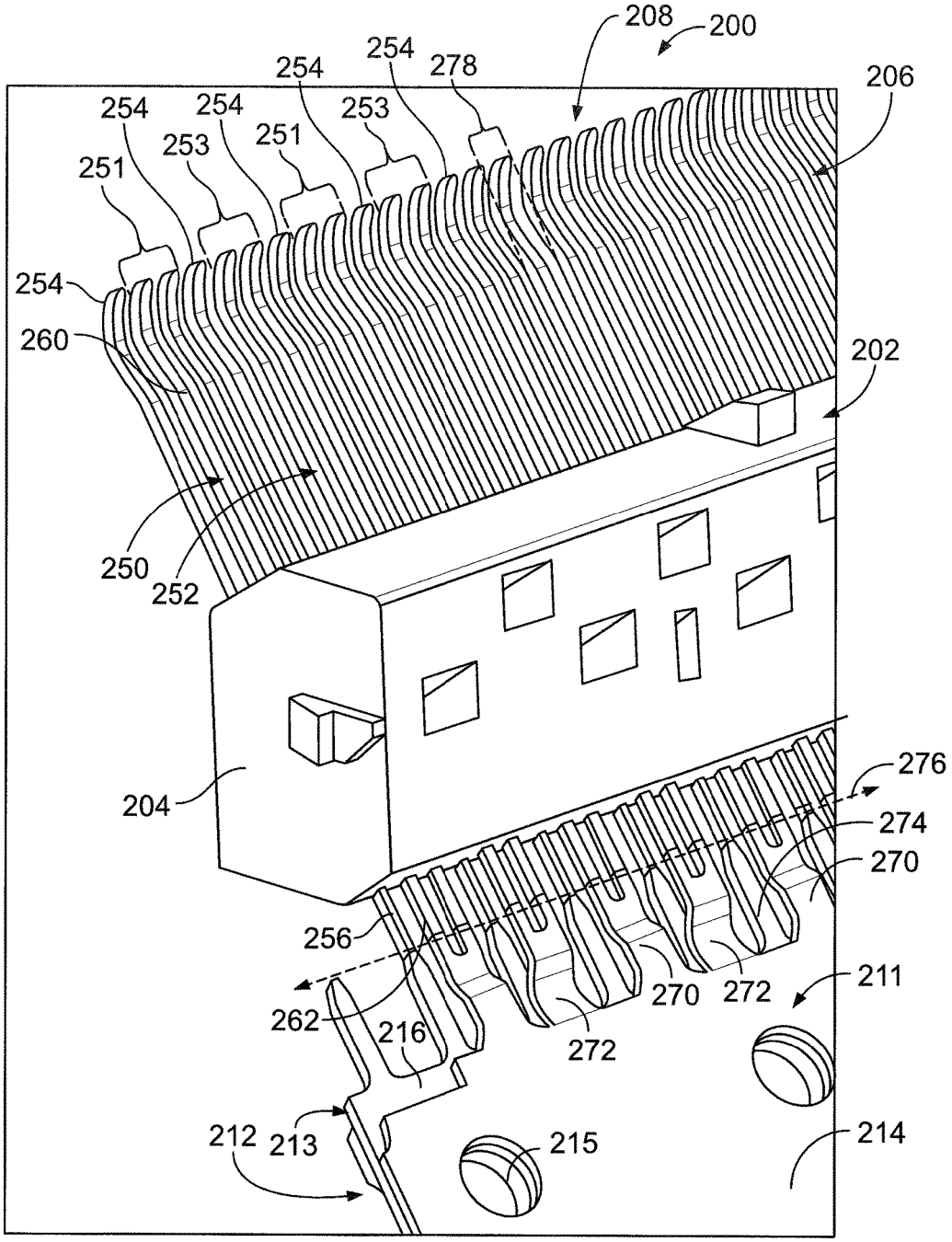
FIG. 5 is an enlarged view of a portion of the manufacturing sub-assembly of FIG. 4.

FIG. 5 is an enlarged view of a portion of the manufacturing sub-assembly 200. In the illustrated embodiment, the electrical conductors 208 include signal conductors 250, 252 and ground conductors 254, 256. The ground conductors 254, 256 are interconnected by a ground bus 284 (shown in FIG. 6) to collectively form a ground frame 282 (shown in FIG. 6).

Each of the signal conductors 250, 252 includes a mating segment 260, a terminating segment 262, and an intermediate segment 264 (shown in FIG. 6) that extends between the corresponding mating and terminating segments 260, 262. The mating segments 260 and the terminating segments 262 are exposed outside of the dielectric carrier 204 and project away from the dielectric carrier 204. The mating segments 260 are configured to engage corresponding contacts of a mating connector (not shown), such as the mating connector 105 (FIG. 2). The intermediate segments 264 extend through the dielectric carrier 204.

The signal conductors 250, 252 include first conductors 250 and second conductors 252. The first conductors 250 are formed from the first signal blank 211, and the second conductors 252 are formed from the second signal blank 212. The ground conductors 254, 256 are formed from the ground blank 213. In the illustrated embodiment, the ground conductors 254, 256 are interleaved between adjacent first and second conductors 250, 252. More specifically, the ground conductors 254 are interleaved between the mating segments 260 of adjacent first and second conductors 250, 252, and the ground conductors 256 are interleaved between the terminating segments 262 of the adjacent first and second conductors 250, 252.

In the illustrated embodiment, the first conductors 250 are arranged in signal pairs 251, and the second conductors 252 are arranged in signal pairs 253. The signal pairs 251, 253 alternate laterally along the conductor row 206. The ground conductors 254 are interleaved between adjacent signal pairs 251, 253 such that the conductor row 206 has a ground-signal-signal-ground (GSSG) pattern. Also shown, the ground conductors 256 are interleaved between the adjacent signal pairs 251, 253.

Figure 6:
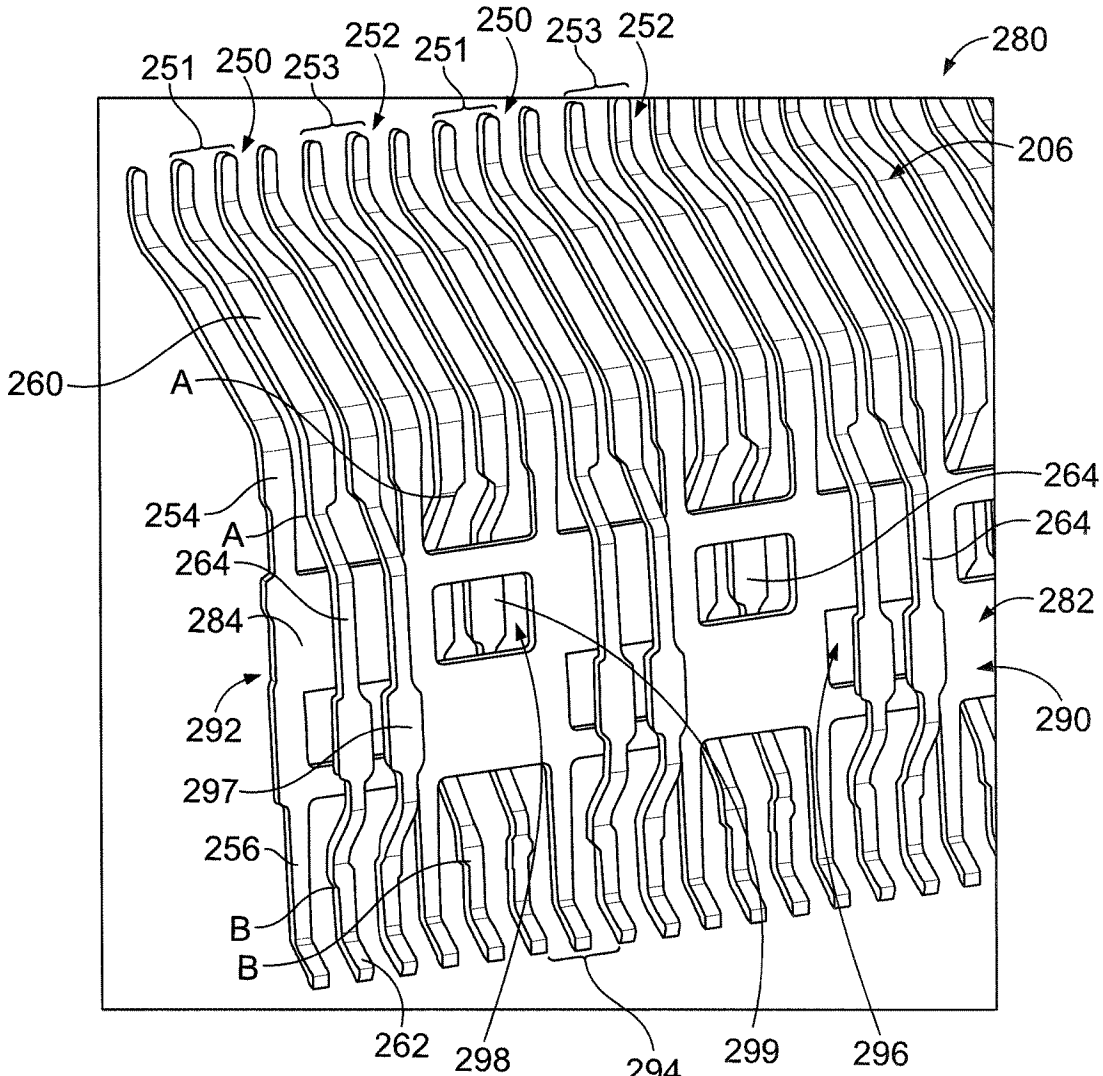
FIG. 6 is an isolated perspective view of a portion of a communication assembly of the connector sub-assembly that includes a ground frame and signal conductors.

The first conductors 250 are connected to the body panel 214 through respective bridges 270 of the first signal blank 211. The second conductors 252 are connected to the body panel 215 through respective bridges 272 of the second signal blank 212. The ground conductors 256 are connected to the body panel 216 through respective bridges 274 of the ground blank 213. In the illustrated embodiment, the bridges 270, 272 support signal pairs 251, 253, respectively. Collectively, the bridges 274 support the ground frame 282 (FIG. 6). As shown in FIG. 5, the bridges 270, 272 alternate in a lateral direction and are shaped to align the signal pairs 251, 253 with the ground conductors 256. In particular, the terminating segments 262 of the first and second conductors 250, 252 and the ground conductors 256 may coincide with a plane 302 (shown in FIGS. 7-9).

By using multiple conductive blanks 211-213 in which each conductive blank includes a sub-array or group of the electrical conductors 208, the ground conductors 254, 256 may be electrically commoned while also achieving a greater density of electrical conductors 208. For example, the conductor row 206 may have a center-to-center spacing 278 that is at most 1.0 millimeter (mm). In some embodiments, the center-to-center spacing 278 may be at most 0.8 mm. In certain embodiments, the center-to-center spacing 278 may be at most 0.6 mm. In more particular embodiments, the center-to-center spacing 278 may be at most 0.4 mm.

To separate the connector sub-assembly 202 from the remainder of the manufacturing sub-assembly 200, the first conductors 250, the second conductors 252, and the ground conductors 256 may be separated from the bridges 270, 272, 274, respectively, along a lateral break line 276. The first conductors 250, the second conductors 252, and the ground conductors 256 may be separated by, for example, etching the conductors or stamping the conductors.

FIG. 6 is an isolated perspective view of a portion of a communication assembly 280. The communication assembly 280 represents the signal pathways and ground pathways of the connector sub-assembly 202 (FIG. 4). More specifically, the communication sub-assembly 280 includes the first conductors 250, the second conductors 252, and the ground frame 282. The ground frame 282 includes the ground conductors 254, 256 and the ground bus 284. During operation in which the connector sub-assembly 202 communicates data signals, the first conductors 250 (or the signal pairs 251), the second conductors 252 (or the signal pairs 253), and the ground frame 282 may have the relative positions shown in FIG. 6.

The ground bus 284 interconnects the ground conductors 254, 256 such that the ground conductors 254, 256 are electrically commoned. In such embodiments, the ground frame 282 may impede the development of resonating conditions. In the illustrated embodiment, the ground bus 284 has a planar body or 2D shape. In other embodiments, however, the ground bus 284 may have a three-dimensional (3D) shape.

The intermediate segments 264 of the first and second conductors 250, 252 extend between points A and B in FIG. 6. After the connector sub-assembly 202 (FIG. 4) is separated from the remainder of the manufacturing sub-assembly 200 (FIG. 4), the mating segments 260 and the terminating segments 262 may be shaped (e.g., bent) into operating positions, which are shown in FIG. 6. In the operating positions, the terminating segments 262 are poised for being mechanically and electrically coupled (e.g., soldered or welded) to corresponding conductive pads (not shown) of a circuit board (not shown), such as the circuit board 102 (FIG. 1). In alternative embodiments, the terminating segments 262 may have other shapes for being terminated to another component. For example, the terminating segments 262 may include compliant pins (e.g., eye-of-needle contacts). In the operating positions, the mating segments 260 and the ground conductors 254 are poised for engaging corresponding contacts (not shown) of the mating connector. The mating segments 260 and the ground conductors 254 are laterally aligned side-by-side.

The first conductors 250 have essentially identical shapes, and the second conductors 252 have essentially identical shapes. As used herein, the phrase "essentially identical shapes" allows for at least some regions in which the conductors do not have the same shape due to manufacturing tolerances. In particular embodiments, the mating segments 260 of the first conductors 250 and the second conductors 252 have essentially identical shapes.

In FIG. 6, the mating segments 260 of the first and second conductors 250, 252 extend essentially parallel to one another in the conductor row 206. As used herein, the phrase "essentially parallel" allows for at least some regions in which the conductors are not parallel to each other due to manufacturing tolerances or minor variances. The terminating segments 262 may have similar spatial relationships. For example, the terminating segments 262 of the first and second conductors 250, 252 may have essentially identical shapes and may be oriented essentially parallel to one another.

As described above, the first conductors 250, the second conductors 252, and the ground frame 282 may be provided by different conductive blanks. In such embodiments, the first conductors 250, the second conductors 252, and the ground frame 282 may have qualities or characteristics that are indicative of originating from different conductive blanks. For example, the ground frame 282 comprises a ground material, and the first and second conductors 250, 252 comprise a signal material. Optionally, the signal material and the ground material may be different materials. More specifically, the signal material and the ground material may have different compositions.

As another example, the first conductors 250, the second conductors 252, and/or the ground frame 282 may have different structural features that are indicative of undergoing different manufacturing processes. For example, the first conductors 250, the second conductors 252, and/or the ground conductors 254, 256 may have different amounts of plating. For instance, the plating for the first and second conductors 250, 252 and the ground conductors 254 may have different thicknesses. As another example, the plating for the first and second conductors 250, 252 and the ground conductors 254 may have different lengths measured from ends of the respective conductors. It may be possible to identify the different structural features by, for example, inspecting the first conductors 250, the second conductors 252, and/or the ground conductors 254, 256 using a scanning electron microscope (SEM) or a surface profilometer.

FIGS. 5 and 6 illustrate another example of the ground frame 282 originating from a different conductive blank than the first conductors 250 and the second conductors 252. When the dielectric carrier 204 (FIG. 4) is a single overmolded part that encases the first conductors 250, the second conductors 252, and the ground frame 282, it would be impossible for the first conductors 250, the second conductors 252, and the ground frame 282 to be provided by the same conductive blank, because the first conductors 250 and the second conductors 252 overlap with the ground bus 284. It would also be impossible for the first conductors 250 and the second conductors 252 to be provided by the same shaping process, because the first conductors 250 and the second conductors 252 have different 3D shapes. Accordingly, various structural features may be identified that indicate the first conductors 250, the second conductors 252, and/or the ground frame 282 originate from different conductive blanks.

Also shown in FIG. 6, the ground bus 284 has a first side 290 and an opposite second side 292. The first and second sides 290, 292 may be, for example, the opposite side surfaces of the sheet of material from which the ground frame 282 is formed. As shown, the intermediate segments 264 of the first conductors 250 extend adjacent to the first side 290 of the ground bus 284, and the intermediate segments 264 of the second conductors 252 extend adjacent to the second side 292 of the ground bus 284. Accordingly, the first conductors 250 and the second conductors 252 extend along opposite sides of the ground bus 284. In such embodiments, the ground bus 284 may be positioned between the first conductors 250 and the second conductors 252 thereby reducing crosstalk between adjacent first and second conductors 250, 252 (or adjacent signal pairs 251, 253).

In the illustrated embodiment, the ground bus 284 has a 2D shape (or planar body) and the intermediate segments 264 of the first and second conductors 250, 252 have non-linear paths that extend around the ground bus 284. In other embodiments, it is contemplated that the ground bus 284 may have a 3D shape such that the ground bus 284 extends around the first conductors 250 and the second conductors 252 and in between adjacent first and second conductors 250, 252. In one or more other embodiments, the first and second conductors 250, 252 may have non-linear paths that extend around the ground bus 284, and the ground bus 284 may have a 3D shape. The ground bus 284 may weave between adjacent first and second conductors 250, 252 (or adjacent signal pairs 251, 253). The non-linear paths may be shaped to increase corresponding gaps 294 between the adjacent first and second conductors 250, 252.

In the illustrated embodiment, the ground bus 284 includes a plurality of windows 296, 298 therethrough. The first conductors 250 may extend across corresponding windows 296, and the second conductors 252 may extend across corresponding windows 298. Optionally, the first conductors 250 may have sub-segments 297 with increased widths as the first conductors 250 cross the corresponding windows 296. The second conductors 252 may have sub-segments 299 with increased widths as the second conductors 252 cross the corresponding windows 298. The sub-segments 297 and the windows 296 may align with the air channels 236 (FIG. 4), and the sub-segments 299 and the windows 298 may align with the air channels 238 (FIG. 4). The air channels 236, 238 and the sub-segments 297, 299 may be sized, shaped, and positioned relative to one another to achieve a target performance.

Figure 7:
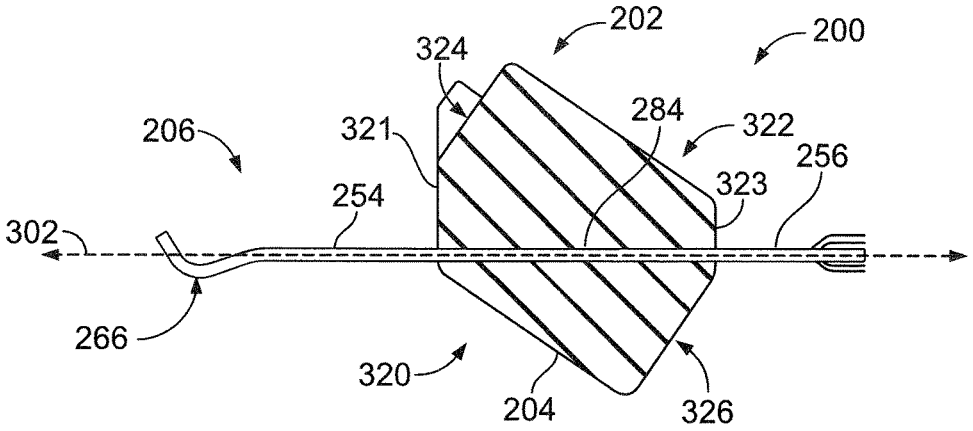
FIG. 7 is a side cross-section of a portion of the manufacturing sub-assembly taken along the ground frame.
Figure 8:
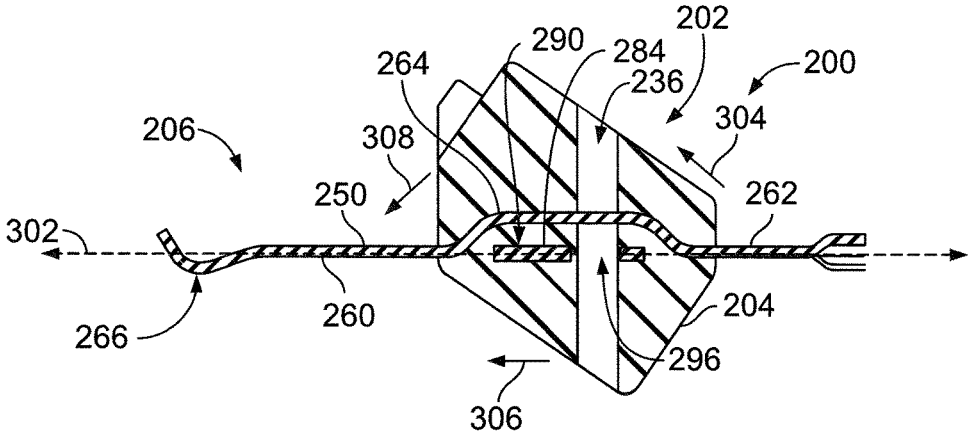
FIG. 8 is a side cross-section of a portion of the manufacturing sub-assembly taken along a first signal conductor.
Figure 9:
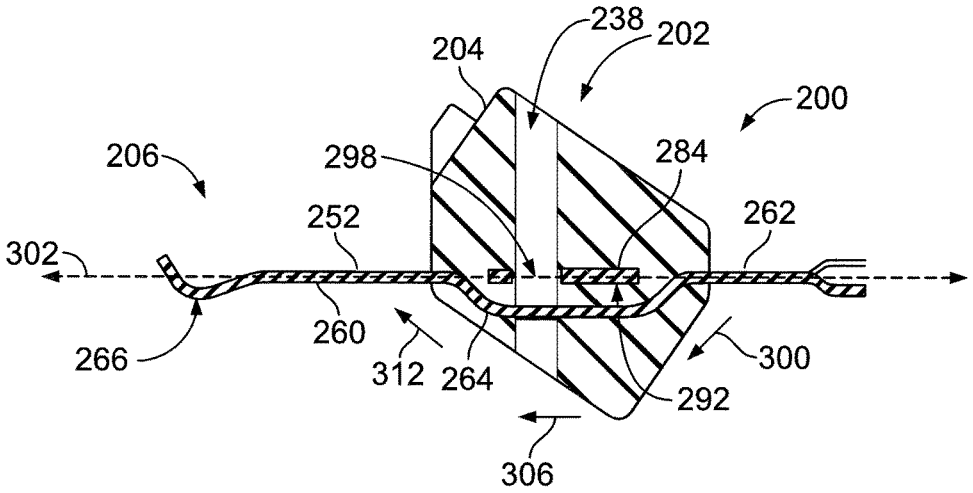
FIG. 9 is a side cross-section of a portion of the manufacturing sub-assembly taken along a second signal conductor.

FIGS. 7-9 show side cross-sections of a portion of the manufacturing sub-assembly 200. FIG. 7 is taken along exemplary ground conductors 254, 256 and the ground bus 284. FIG. 8 is taken along an exemplary first conductor 250 and the ground bus 284, and FIG. 9 is taken along an exemplary second conductor 252 and the ground bus 284. The conductors of the conductor row 206 have not been shaped (e.g., bent) into the operating positions, and the connector sub-assembly 202 has not been separated from the remainder of the manufacturing sub-assembly 200. As shown, the first conductor 250, the second conductor 252, the ground conductor 254, the ground conductor 256, and the ground bus 284 essentially coincide with a plane 302. After the connector sub-assembly 202 is fully formed, only the ground bus 284 and portions of the first and second conductors 250, 252 that are proximate to an exterior of the dielectric carrier 204 coincide with the assembly plane 302. Also shown, each of the first conductors 250, the second conductors 252, and the ground conductors 254 includes an engagement surface 266 that is configured to directly engage a corresponding contact of the mating connector.

With respect to FIG. 7, the dielectric carrier 204 includes a front side 320, a back side 322, a top side 324, and a bottom side 326. The ground conductors 254 project away from the front side 320, and the ground conductors 256 project away from the back side 322. Optionally, the front side 320 and the back side 322 include angled surfaces 321, 323, respectively.

FIGS. 8 and 9 illustrate the non-linear paths of the intermediate segments 264 of the first and second conductors 250, 252, respectively. With respect to FIG. 8, as the first conductor 250 extends from the corresponding terminating segment 262 to the mating segment 260, the non-linear path of the intermediate segment 264 extends in a first direction 304 away from the plane 302, then in a second direction 306 that is parallel to the plane 302, and then in a third direction 308 that is toward the plane 302. The first conductor 250 extends adjacent to the first side 290 of the ground bus 284 as the first conductor 250 extends in the second direction 306.

With respect to FIG. 9, as the second conductor 252 extends from the corresponding terminating segment 262 to the corresponding mating segment 260, the non-linear path extends in a fourth direction 310 away from the plane 302, then in the second direction 306 that is parallel to the plane 302, and then in a fifth direction 312 that is toward the plane 302. The second conductor 252 extends adjacent to the second side 292 of the ground bus 284 as the second conductor 252 extends in the second direction 306.

As shown by comparing FIGS. 8 and 9, the first and second conductors 250, 252 coincide with the plane 302 proximate to the exterior of the dielectric carrier 302. At this point, the gap 294 (FIG. 6) between adjacent first and second conductors 250, 252 is equal to about two times (2X) the center-to-center spacing 278 (FIG. 5). At some point in the dielectric carrier 204, the first and second conductors 250, 252 diverge and move away from the plane 302 in the first and fourth directions 304, 310, respectively. As the first and second conductors 250, 252 diverge, the gap 294 between the first and second conductors 250, 252 increases. The first and second conductors 250, 252 extend parallel to one another as the first and second conductors 250, 252 extend in the second direction 306.

At some point in the dielectric carrier 204, the first and second conductors 250, 252 converge and move toward the plane 302 in the third and fifth directions 308, 312, respectively. When the first and second conductors 250, 252 coincide again with the plane 302 proximate to the exterior of the dielectric carrier 302, the gap 294 (FIG. 6) is equal to about 2× the center-to-center spacing 278 (FIG. 5). Although the first and second conductors 250, 252 are shown as converging and diverging in the dielectric carrier 204, it should be understood that the first and second conductors 250, 252 may converge and diverge when positioned outside of the dielectric carrier 204.

In the illustrated embodiment, the dielectric carrier 204 is overmolded such that the dielectric carrier 204 encases the intermediate segments 264 and the ground bus 284. Optionally, the dielectric carrier 204 may include the air channel 236 (FIG. 8) and the air channel 238 (FIG. 9). The air channel 236 extends through a corresponding window 296 (FIG. 8), and the air channel 238 extends through a corresponding window 298 (FIG. 9). The first conductor 250 extends through the air channel 236, and the second conductor 252 extends through the air channel 238.

Figure 10:
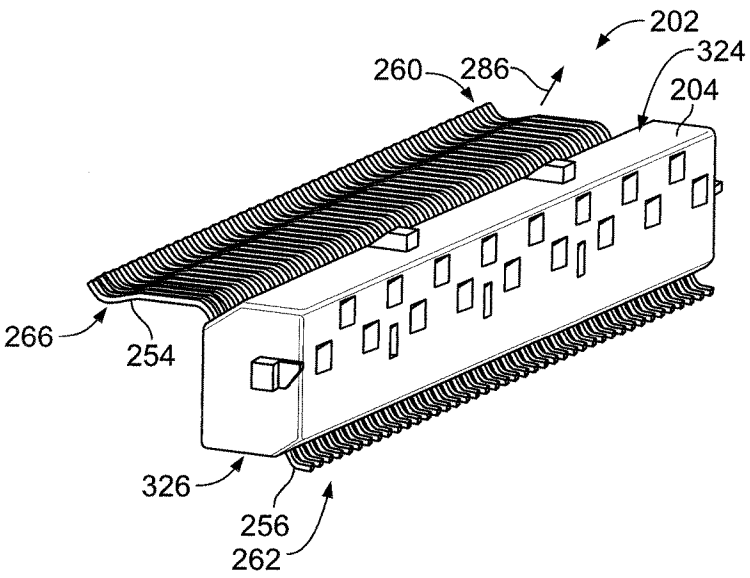
FIG. 10 is a rear perspective view of the connector sub-assembly in accordance with an embodiment that is constructed from the manufacturing sub-assembly of FIG. 4.

FIG. 10 is a rear perspective view of the connector sub-assembly 202 after the connector sub-assembly 202 is fully constructed and the mating segments 260, the ground conductors 254, the terminating segments 262, and the ground conductors 256 are in the operating positions. The terminating segments 262 and the ground conductors 256 are positioned to be substantially co-planar with the bottom side 326 of the dielectric carrier 204. In some embodiments, the mating segments 260 are shaped to have an elevation that is not greater than the top side 324 of the dielectric carrier 204. The connector sub-assembly 202 may be positioned within a cavity, such as the connector cavity 112 (FIG. 1), of a connector housing to form an electrical connector.

During a mating operation, the mating segments 260 and the ground conductors 254 may be deflected (as indicated by the arrow 286). When deflected, the mating segments 260 and the ground conductors 254 generate a biasing force in the opposite direction of the arrow 286 that may maintain a sufficient electrical connection between the engagement surfaces 266 and the corresponding contacts of the mating connector. In the illustrated embodiment, the engagement surfaces 266 are essentially co-planar. As used herein, the phrase "essentially co-planar," when used with respect to the engagement surfaces, allows for minor offsets due to manufacturing tolerances or for minor offsets that permit the engagement surfaces to engage the corresponding contacts at a designated sequence. For example, the ground conductors 254 may be configured to engage the corresponding contacts prior to the mating segments 260 engaging the corresponding contacts.

Figure 11:
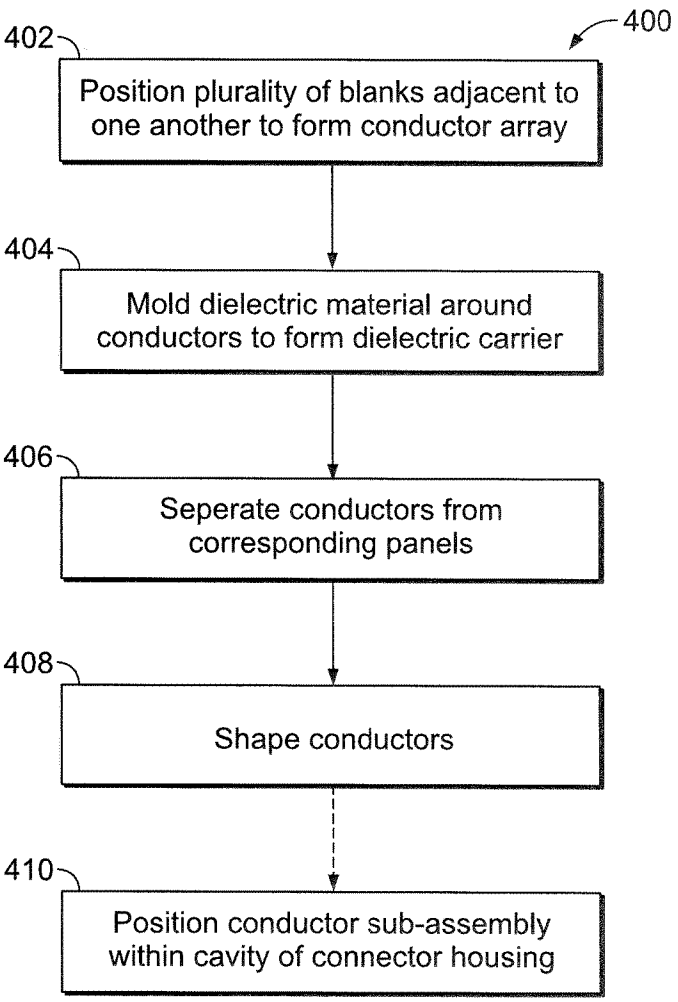
FIG. 11 is a method of assembling a connector sub-assembly in accordance with an embodiment.

FIG. 11 is a method 400 of assembling a connector sub-assembly in accordance with an embodiment. The method 400, for example, may employ structures or aspects of various embodiments discussed herein. In various embodiments, certain steps may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion.

The method 400 includes positioning, at 402, a plurality of conductive blanks adjacent to one another such that a conductor array is formed. For example, the conductive blanks may have respective body panels and respective electrical conductors that extend away from edges of the respective body panels. When the conductive blanks are positioned adjacent to one another, the electrical conductors (or portions thereof) of one conductive blank may be positioned between and, optionally, co-planar with the electrical conductors (or portions thereof) of another conductive blank or blanks. For example, the mating segments of the electrical conductors may be co-planar. The number of conductive blanks may be two, three, four, or more. Optionally, at least one of the conductive blanks is a ground blank having ground conductors and/or a ground bus attached thereto.

The method 400 may also include molding, at 404, a dielectric material around the electrical conductors to form a dielectric carrier. For example, the electrical conductors of the conductive blanks may be positioned within the cavity of a mold while attached to the corresponding body panels. In particular embodiments, the molding operation at 404 may be a single-shot molding process such that a single, unitary part encases the electrical conductors. In other embodiments, more than one molding process may be used to form the dielectric carrier.

At 406, the conductors may be separated from the corresponding body panels. For example, the conductors may be etched or stamped to separate the conductors from the corresponding body panels. At 408, the electrical conductors may be shaped. For example, the mating segments of the electrical conductors may be shaped so that the array has a designated configuration. Upon completion of the shaping operation at 408, the connector sub-assembly may be fully assembled. Optionally, the method 400 may include positioning, at 410, the connector sub-assembly within the cavity of a connector housing thereby forming an electrical connector.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112(f), unless and until such claim limitations expressly use the phrase "means for" followed by a statement of function void of further structure.

What is claimed is:

1. A connector sub-assembly for an electrical connector, the connector sub-assembly comprising:

a plurality of signal conductors in which each signal conductor includes a mating segment, a terminating segment, and an intermediate segment that extends between the corresponding mating and terminating segments;

a ground frame including ground conductors and a ground bus that interconnects the ground conductors, the ground bus having opposite first and second sides; and a dielectric carrier surrounding the ground bus and the intermediate segments of the signal conductors, the mating segments of the signal conductors projecting from the dielectric carrier and being configured to engage corresponding contacts of a mating connector;

wherein the signal conductors include first conductors and second conductors and the ground conductors are interleaved between adjacent first and second conductors, the intermediate segments of the first conductors extending adjacent to the first side of the ground bus, the intermediate segments of the second conductors extending adjacent to the second side of the ground bus.

2. The connector sub-assembly of claim 1, wherein the intermediate segments of the first and second conductors have non-linear paths that extend around the ground bus.

3. The connector sub-assembly of claim 1, wherein the intermediate segments of the first and second conductors have non-linear paths that are shaped to increase corresponding gaps between the adjacent first and second conductors.

4. The connector sub-assembly of claim 1, wherein the signal conductors and the ground conductors form a conductor row having a center-to-center spacing that is at most 0.6 millimeter (mm).

5. The connector sub-assembly of claim 1, wherein the first conductors form first signal pairs and the second conductors form second signal pairs, the ground conductors being interleaved between the first and second signal pairs to form a ground-signal-signal-ground (GSSG) pattern.

6. The connector sub-assembly of claim 1, wherein the mating segments of the signal conductors extend essentially parallel to one another and the terminating segments of the signal conductors extend essentially parallel to one another.

7. The connector sub-assembly of claim 1, wherein the ground bus has an essentially planar body.

8. The connector sub-assembly of claim 1, wherein the first conductors have identical shapes and the second conductors have identical shapes, the first and second conductors having different shapes.

9. The connector sub-assembly of claim 1, wherein the dielectric carrier is an overmolded dielectric carrier that encases the ground bus and the intermediate segments of the signal conductors.

10. The connector sub-assembly of claim 1, wherein the ground bus includes a plurality of windows therethrough and the dielectric carrier includes air channels, the first and second conductors extending across respective windows of the ground bus and through respective air channels.

11. The connector sub-assembly of claim 1, wherein the ground frame comprises a ground material and the first and second conductors comprise a signal material, the signal material and the ground material being different.

12. The connector sub-assembly of claim 1, wherein the first conductors and the second conductors have different structural features that are indicative of originating from different conductive blanks.

13. An electrical connector comprising:

a connector housing having a mating side and a loading side and a connector cavity that opens to the mating side and to the loading side; and a connector sub-assembly disposed within the connector cavity, the connector sub-assembly comprising:

a plurality of signal conductors in which each signal conductor includes a mating segment, a terminating segment, and an intermediate segment that extends between the corresponding mating and terminating segments;

a ground frame including ground conductors and a ground bus that interconnects the ground conductors, the ground bus having opposite first and second sides; and a dielectric carrier surrounding the ground bus and the intermediate segments of the signal conductors, the mating segments of the signal conductors projecting from the dielectric carrier and being configured to engage corresponding contacts of a mating connector;

wherein the signal conductors include first conductors and second conductors and the ground conductors are interleaved between adjacent first and second conductors, the intermediate segments of the first conductors extending adjacent to the first side of the ground bus, the intermediate segments of the second conductors extending adjacent to the second side of the ground bus.

14. The electrical connector of claim 13, wherein the intermediate segments of the first and second conductors have non-linear paths that extend around the ground bus.

15. The electrical connector of claim 13, wherein the intermediate segments of the first and second conductors have non-linear paths that are shaped to increase corresponding gaps between the adjacent first and second conductors.

16. The electrical connector of claim 13, wherein the first conductors form first signal pairs and the second conductors form second signal pairs, the ground conductors being interleaved between the first and second signal pairs to form a ground-signal-signal-ground (GSSG) pattern, wherein the signal conductors and the ground conductors form a conductor row having a center-to-center spacing that is at most 0.6 millimeter (mm).

17. The electrical connector of claim 13, wherein the dielectric carrier is an overmolded dielectric carrier that encases the ground bus and the intermediate segments of the signal conductors.

18. The electrical connector of claim 13, wherein at least one of:

(a) the ground frame comprises a ground material and the first and second conductors comprise a signal material, the signal material and the ground material being different; or (b) the first conductors and the second conductors have different structural features that are indicative of originating from different conductive blanks.

* * * * *